US011959289B2

(12) United States Patent
Presto

(10) Patent No.: US 11,959,289 B2
(45) Date of Patent: Apr. 16, 2024

(54) CONCRETE MASONRY UNIT CAP

(71) Applicant: Robert S. Presto, Huntsville, AL (US)

(72) Inventor: Robert S. Presto, Huntsville, AL (US)

( * ) Notice: Subject to any disclaimer, the term of this patent is extended or adjusted under 35 U.S.C. 154(b) by 0 days.

(21) Appl. No.: 17/130,188

(22) Filed: Dec. 22, 2020

(65) Prior Publication Data

US 2021/0198909 A1 Jul. 1, 2021

Related U.S. Application Data

(60) Provisional application No. 62/953,717, filed on Dec. 26, 2019.

(51) Int. Cl.
*E04G 21/30* (2006.01)

(52) U.S. Cl.
CPC ..... *E04G 21/30* (2013.01)

(58) Field of Classification Search
CPC ..... E04B 1/7046; E04B 1/7061; E04B 2/68; E04C 5/161; E04G 21/30
See application file for complete search history.

(56) References Cited

U.S. PATENT DOCUMENTS 2,055,184 A * 9/1936 Stirrup ..... E04B 2/48 52/421
3,780,773 A * 12/1973 Haugen ..... B65D 59/06 52/421
5,845,444 A * 12/1998 Besche ..... E04B 2/48 52/421
5,870,864 A * 2/1999 Snyder ..... E04B 1/70 52/302.1
2004/0231261 A1* 11/2004 Sourlis ..... E04B 1/703 52/302.1
2012/0096805 A1* 4/2012 Vasta ..... E04G 21/30 52/749.13
2012/0291381 A1* 11/2012 Kassarjian ..... B65D 59/06 52/301
2016/0186435 A1* 6/2016 Hewlett ..... E04C 5/161 52/300
2018/0051436 A1* 2/2018 Smith ..... E02D 29/025

FOREIGN PATENT DOCUMENTS

DE 4317685 A1 * 12/1993 ..... E04B 1/7046
FR 2648498 A2 * 12/1990 ..... E04G 21/32
GB 2162878 A * 2/1986 ..... E04B 1/7046
RU 2082859 C1 * 6/1997 ..... E04B 1/7046

* cited by examiner

*Primary Examiner* — Christine T Cajilig
(74) *Attorney, Agent, or Firm* — Jeremy A. Smith; Lanier Ford Shaver & Payne, P.C.

(57) ABSTRACT

The present disclosure provides a cap 10 having a face 20, a rear 30 and a core space insertion tab 100. In an alternate embodiment, the present disclosure provides a cap for a concrete masonry unit comprising a face, a rear and a core space installation tab, a lower sloped face and a lower edge, wherein the face further comprises a grip and wherein the lower sloped face and lower edge below the grip.

12 Claims, 4 Drawing Sheets

CONCRETE MASONRY UNIT CAP

REFERENCE TO PENDING APPLICATIONS

This application claims priority to, and the benefit of, U.S. Provisional Patent Application No. 62/953,717 filed on Dec. 26, 2019.

FIELD OF THE DISCLOSURE

The present disclosure pertains to the field of residential, commercial, and industrial construction. More specifically, the disclosure describes and relates to a cap (the "CELL BLOCKER™"), which is designed to prevent the unwanted encroachment of gravel and other debris into the cells or core spaces of concrete masonry units ("CMUs") until such time as the core spaces may be poured with concrete in order to enhance their strength and stability.

BACKGROUND

CMUs, or concrete blocks, are ubiquitous in today's construction industry. They are used extensively in commercial, residential, and industrial construction projects for the building of floor-to-ceiling wall systems, foundations, retaining walls, and other design components. CMUs are often formed into walls that surround and define an area, such as a block-and-fill slab floor. In such circumstances, once the CMUs are in place, gravel and/or other material must be added into the enclosed floor area prior to the pouring of the pertinent slab. During this process, it is common for a specially designed truck to "sling", "throw", "shoot" or otherwise "propel" large quantities of loose gravel into the area. Otherwise, a loader or other type of heavy equipment is used to deposit gravel into the footprint of the applicable building and/or to spread the gravel within the site once it has been delivered. However, during either process, the placement of the gravel cannot be completely controlled, and as such, gravel improperly encroaches into the individual cells or core spaces of the CMUs. Once gravel intrudes into the CMU core spaces, it effectively and improperly blocks the later pouring of liquid concrete into the cores and prevents the CMUs from later being joined together with concrete. As such, the strength, stability, and durability of the CMU wall structure is impaired. The present disclosure provides a solution to this problem through the use of a removable cap (the CELL BLOCKER™), which fits into the top of the individual CMU cores or cells and prevents gravel and other debris from entering the cells before they (the cells or core spaces) may be filled with liquid concrete.

BRIEF DESCRIPTION OF THE DRAWINGS

To further illustrate the advantages and features of the present disclosure, a more particular description of the invention will be rendered by reference to specific embodiments thereof which are illustrated in the appended drawings. The Applicant states that it is to be appreciated that these drawings are not to be considered limiting in scope. The invention will be described and explained with additional specificity and detail of the accompanying drawings in which.

DETAILED DESCRIPTION

Figure 1:
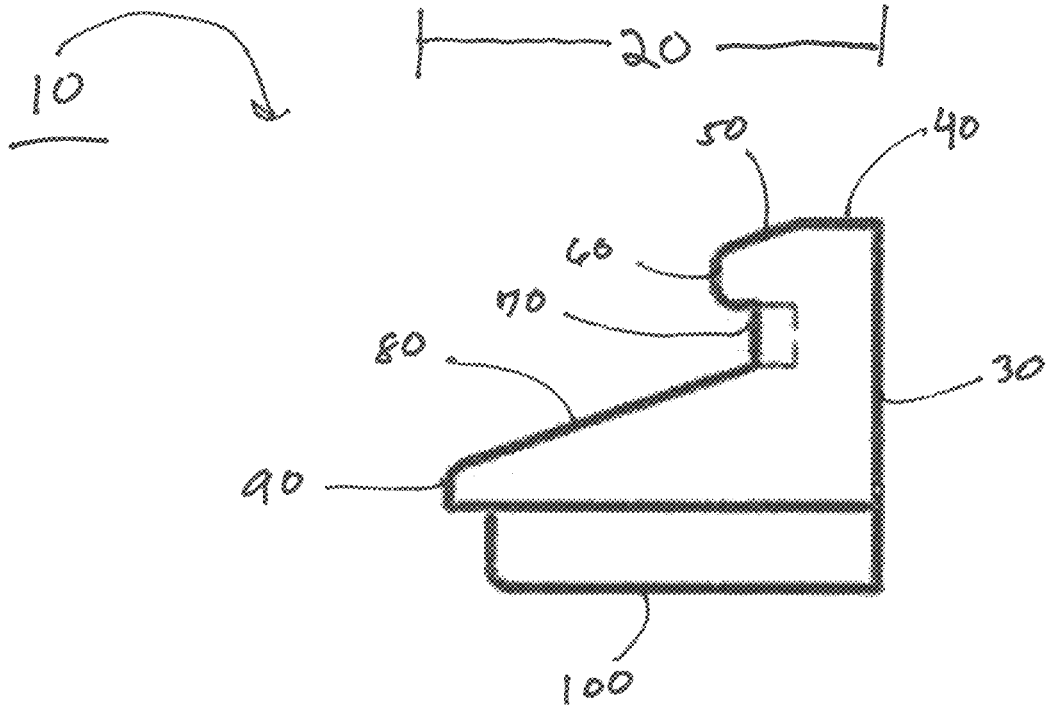
FIG. 1 shows a side view of the cap 10.
Figure 2:
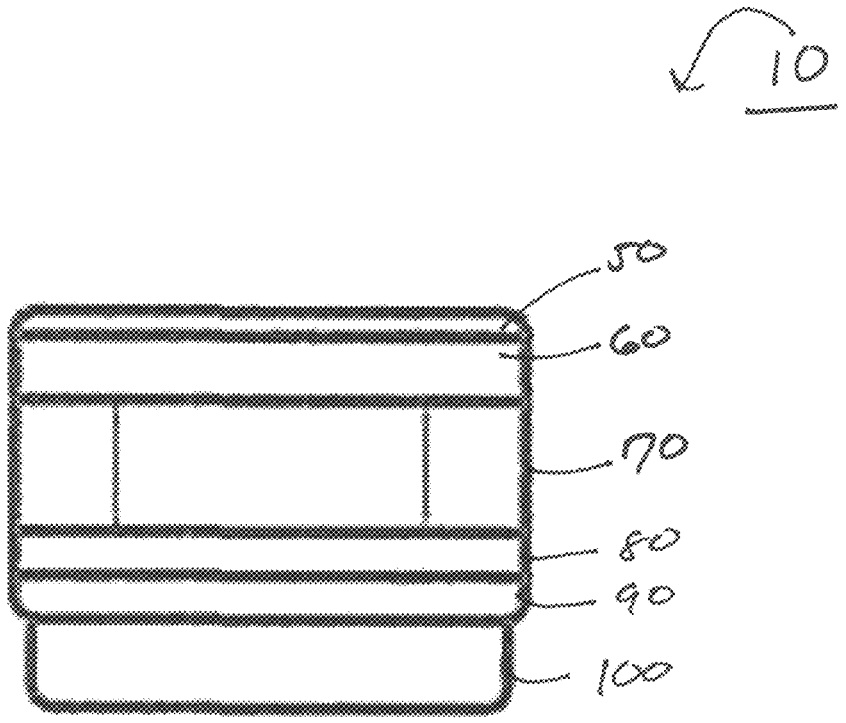
FIG. 2 shows a front view of the cap 10.
Figure 3:
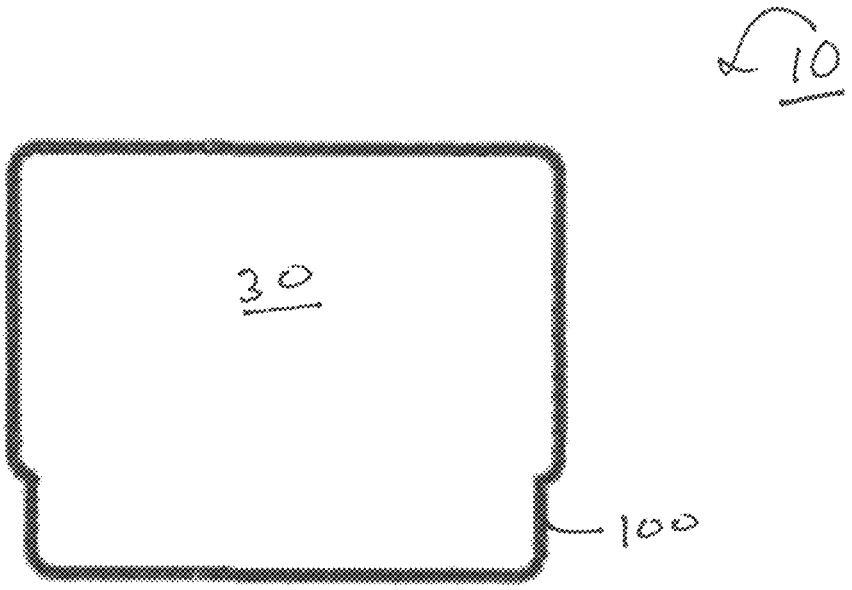
FIG. 3 shows a back view of the cap 10.
Figure 4:
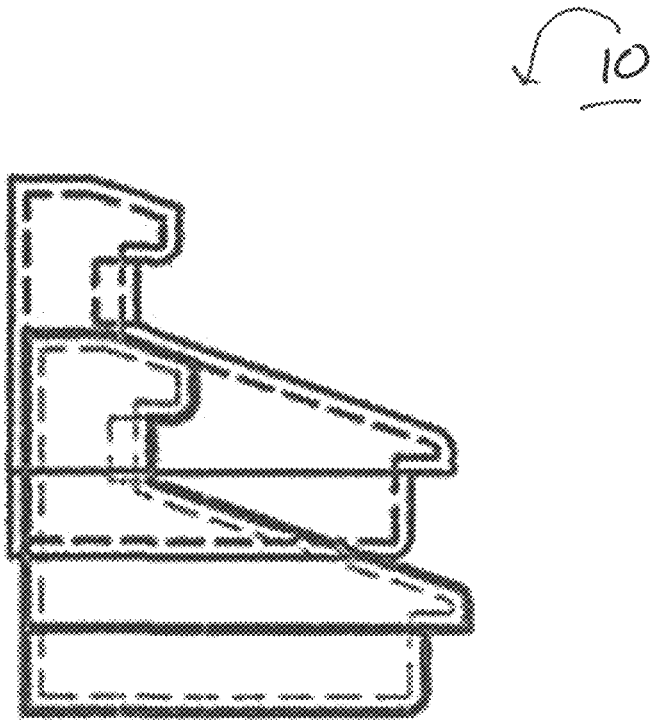
FIG. 4 shows two (2) caps 10 nested together.

Now referring to FIGS. 1-4 and the attached appendix, the present disclosure provides a cap 10 having a face 20, a rear 30 and a core space insertion tab 100. The cap 10 may be constructed from any number of materials, including without limitation plastics such as PA(nylon), high density polyethylene (HDPE) or rubber. The cap 10 may be also be constructed out of polyethylene terephthalate (PET or PETE), polyvinyl chloride (PVC) or other suitable materials. The CELL BLOCKER™ may be constructed using an injection molding process and may be formed either as individual units or as a connected string of CELL BLOCKERS™ for quicker and easier installation within multiple CMU cavities. In one embodiment, it is desirable for the cap 10 to flex slightly when pressure is applied.

The face 20 of the cap includes a grip which is comprised of a top 40, an upper-sloped face 50, an upper edge 60, and a recess area 70. The grip is useful as it allows the cap 10 to be inserted or removed easily and quickly by simply grasping the grip and either pushing the cap 10 into place or by pulling on the grip to remove the cap 10.

Below the grip, the face 20 comprises a lower sloped face 80 and lower edge 90. As will be noted in the attached drawings, most of the surfaces of the cap 10 are sloped which will allow gravel or other materials to slide off the cap 10 easily.

The cap 10 also includes a core space insertion tab 100 which is adapted and configured to snuggly, yet removably, fit inside of the core space of a CMU. In one embodiment, each cap 10 only includes one core space insertion tab 100, although it is possible and within the scope of this disclosure for the cap 10 to have a plurality of core space insertion tabs 100 and thus be capable of being inserted into the core spaces of numerous CMUs at once.

In one embodiment, the cap 10 is essentially hollow which will allow multiple caps 10 to be stacked or nested on top of one another to reduce the storage spaced needed. Additionally, the cap 10 may be a bright color, such as green, yellow or orange to increase the visibility of the cap 10 within and around a work site.

To use the cap 10, a worker simply aligns the core space insertion tab 100 with the core space of the CMU and firmly pushes the core space insertion tab 100 into the core space. Once all of the CMUs are capped, gravel or other material may be added as desired. Once the process of adding gravel or other material is complete, the CELL BLOCKERS™ may be easily cleaned of any loose debris and removed from the core space by grasping the grip and pulling upward and outward with only minimal force. At that point, the CMU cells or core spaces remain empty and free from unwanted debris and can be successfully poured with liquid concrete. In one embodiment, the cap 10 may be re-suable whereas in another embodiment the cap 10 may be disposable such that it is disposed of after a single use.

Although particular embodiments of the present disclosure have been described, it is not intended that such references be construed as limitations upon the scope of this disclosure except as set forth in the claims.

I claim:

1. A cap for a concrete masonry unit comprising a sloping face, a rear and a core space installation tab on the bottom of the cap and extending in a downward direction from the bottom, wherein the sloping face slopes downwardly away from the rear of the cap and comprises a grip which further comprises an upper edge and a recess area and wherein the face further comprises a lower sloped face and lower edge below the grip.

2. The cap of claim 1 further comprising a plurality of core space installation tabs.

3. The cap of claim 1 further comprising a hollow interior.

4. The cap of claim 1 further comprising a plurality of core space installation tabs.

5. The cap of claim 4 further comprising a hollow interior.

6. The cap of claim 1 wherein the cap comprises PA(nylon), high density polyethylene (HDPE), rubber, of polyethylene terephthalate (PET or PETE) or polyvinyl chloride (PVC).

7. The cap of claim 5 wherein the cap comprises PA(nylon), high density polyethylene (HDPE), rubber, of polyethylene terephthalate (PET or PETE) or polyvinyl chloride (PVC).

8. A cap for a concrete masonry unit comprising a face, a rear and a plurality of core space installation tab on the bottom of the cap and extending in a downward direction from the bottom, a lower sloped face and a lower edge, wherein (i) the face further comprises a grip, (ii) the lower sloped face and lower edge are below the grip and wherein the sloping face slopes downwardly away from the rear of the cap.

9. The cap of claim 8 further comprising a hollow interior.

10. The cap of claim 8 wherein the cap comprises PA(nylon), high density polyethylene (HDPE), rubber, of polyethylene terephthalate (PET or PETE) or polyvinyl chloride (PVC).

11. The cap of claim 9 wherein the cap comprises PA(nylon), high density polyethylene (HDPE), rubber, of polyethylene terephthalate (PET or PETE) or polyvinyl chloride (PVC).

12. The cap of claim 10 further comprising a plurality of core space installation tabs.

* * * * *